US009063467B2

(12) United States Patent
Suzuki

(10) Patent No.: US 9,063,467 B2
(45) Date of Patent: Jun. 23, 2015

(54) IMAGE FORMING APPARATUS WITH DUAL IMAGE FORMING SPEEDS

(75) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 5 days.

(21) Appl. No.: 13/304,914

(22) Filed: Nov. 28, 2011

(65) Prior Publication Data

US 2012/0155900 A1 Jun. 21, 2012

(30) Foreign Application Priority Data

Dec. 15, 2010 (JP) ..... 2010-278977

(51) Int. Cl.
*G03G 15/08* (2006.01)
*G03G 15/00* (2006.01)

(52) U.S. Cl.
CPC ..... *G03G 15/0893* (2013.01); *G03G 15/0877* (2013.01)

(58) Field of Classification Search
CPC ..... G03G 15/0893; G03G 15/0877
USPC ..... 399/53, 222, 252, 253, 254, 256, 263, 399/258, 82, 85
See application file for complete search history.

(56) References Cited

U.S. PATENT DOCUMENTS

| | | | | |
|---|---|---|---|---|
| 7,317,889 | B2 | 1/2008 | Suzuki | |
| 7,729,641 | B2 | 6/2010 | Suzuki | |
| 2006/0127133 | A1 * | 6/2006 | Suzuki | 399/167 |
| 2007/0036566 | A1 * | 2/2007 | Takeuchi et al. | 399/27 |
| 2008/0226333 | A1 * | 9/2008 | Ono et al. | 399/99 |
| 2008/0240757 | A1 | 10/2008 | Suzuki | |
| 2010/0189455 | A1 * | 7/2010 | Kim | 399/53 |
| 2011/0052221 | A1 | 3/2011 | Hirobe et al. | |
| 2011/0052233 | A1 * | 3/2011 | Sakamaki | 399/53 |

FOREIGN PATENT DOCUMENTS

| | | | |
|---|---|---|---|
| JP | 5-333691 | A | 12/1993 |
| JP | 9-274387 | A | 10/1997 |
| JP | 2000-227708 | A | 8/2000 |

(Continued)

*Primary Examiner* — Billy Lactaoen
(74) *Attorney, Agent, or Firm* — Fitzpatrick, Cella, Harper & Scinto

(57) ABSTRACT

An image forming apparatus includes an image bearing member, a developer bearing member bearing and conveying a developer to a development position facing the image bearing member, a first chamber, disposed so as to face the developer bearing member, from which the developer is supplied to the developer bearing member, and a second chamber, disposed so as to face the developer bearing member, in which the developer after development in the developer bearing member is collected. In addition, a conveying member is rotatably disposed in the first and second chambers and conveys developer in the first and second chambers for circulating developer between the first and second chambers, and an executing portion executes a first mode in which image formation is performed at a first image forming speed and a second mode in which image formation is performed at a second image forming speed lower than the first image forming speed. A controlling portion, in a case of switching to the second mode after the first mode is performed, controls a target driving speed of the conveying member during a predetermined period to rise temporally at a beginning of the second mode higher than after the predetermined period.

6 Claims, 14 Drawing Sheets

(56) References Cited

FOREIGN PATENT DOCUMENTS

| | | | |
|---|---|---|---|
| JP | 3104722 | B2 | 10/2000 |
| JP | 2005-241675 | A | 9/2005 |
| JP | 3960980 | B2 | 9/2005 |
| JP | 2006-171245 | A | 6/2006 |
| JP | 2008-249769 | A | 10/2008 |
| JP | 2010-122451 | A | 6/2010 |
| JP | 4560397 | B2 | 10/2010 |

* cited by examiner

*FIG. 4*

| | CONSTANT SPEED MODE | LOW-SPEED MODE | SPEED RATIO (LOW SPEED/ CONSTANT SPEED) |
|---|---|---|---|
| PHOTOSENSITIVE DRUM | 121.8 rpm | 60.9 rpm | 0.5 |
| DEVELOPING SLEEVE | 366 rpm | 183 rpm | 0.5 |
| FIRST/SECOND CONVEYING SCREWS | 380 rpm | 288.8 rpm | 0.76 |

*FIG. 12*

| DEVELOPING SLEEVE INTEGRATED ROTATION TIME (IN TERMS OF THE NUMBER OF A4 SHEETS) | PREDETERMINED TIME TILL WHEN ROTATION SPEED IS RETURNED TO STEADY SPEED (sec) |
|---|---|
| 0 TO 100 K | 0.247 |
| 100 TO 200 K | 0.412 |
| 200 TO 350 K | 0.535 |
| 350 K OR MORE | 0.617 |

IMAGE FORMING APPARATUS WITH DUAL IMAGE FORMING SPEEDS

BACKGROUND OF THE INVENTION

1. Field of the Invention

The present invention relates to an image forming apparatus including a development device, such as a copying machine, a printer, a recorded image display apparatus, and a facsimile.

2. Description of the Related Art

Recently, in an image forming apparatus using an electrophotographic system, such as a copying machine and a printer, the apparatus body is strongly required to be reduced in size. Especially in a full-color image forming apparatus, since a plurality of development devices is arranged, the size reduction is especially strongly desired. Thus, there has been known a vertical agitation type development device in which space-saving is realized in comparison with a horizontal agitation type development device (for example, see, Japanese Patent Laid-Open No. 5-333691).

In the vertical agitation type development device, two conveying screws for agitating and mixing a two-component developer are arranged vertically. A first conveying screw conveys a developer in a developing chamber above a development container to supply the developer to a developing sleeve. A second conveying screw conveys the developer in an agitating chamber below the development container and, at the same time, mixes and agitates the developer collected from the developing sleeve and the developer newly supplied.

In the vertical agitation type development device, the developing chamber and the agitation chamber are arranged in the vertical direction as described above, so that the occupied space in the horizontal direction may be small. Thus, even in a tandem system full-color image forming apparatus in which a plurality of developing devices is arranged in parallel in a horizontal direction, for example, the size reduction can be improved.

In the horizontal agitation type development device, the developer is supplied from the developing chamber to the developing sleeve, and the developer after development is collected in the developing chamber again. Thus, the developer whose toner concentration is reduced by development may be supplied to the developing sleeve while being not fully agitated. However, in the vertical agitation type development device, the developer is only supplied from the upper developing chamber to the developing sleeve, and the developer after development is not collected. As described above, since the functions are separated for each chamber, a developer having a uniform toner concentration can be supplied to the developing sleeve.

However, on the other hand, a function separating type development device like the vertical agitation type development device has the following problem. FIG. 14 is an explanatory view for describing a developer surface height variation in the prior-art development device.

As illustrated in FIG. 14, the vertical agitation type development device includes a developing chamber 123 and an agitation chamber 124 separated by a bulkhead 127. A first conveying screw 125 of the developing chamber 123 conveys a developer in the longitudinal direction and, at the same time, supplies a part of the developer to a developing sleeve. Thus, the amount of the developer conveyed by the first conveying screw 125 becomes smaller as it is conveyed further downstream in the conveying direction.

Meanwhile, the developer coated on the developing sleeve passes through a development area and is thereafter temporarily collected by a second conveying screw 126 of the agitation chamber 124. The amount of the developer conveyed by the second conveying screw 126 is increased by the amount of the developer collected from the developing sleeve. Thus, the developer amount becomes larger as the developer is conveyed further downstream in the conveying direction. Accordingly, as illustrated in FIG. 14, in the vertical agitation type development device, the height of an upper surface of the developer (developer surface height) is not fixed in the longitudinal direction, and the developer surface is inclined.

As described above, in the vertical agitation type development device, the developer surface height on the downstream side of the developing chamber (a portion A of FIG. 14) tends to become lower. Thus, when the developer surface height varies for some reasons, the developer surface height of the portion A is further reduced, and it is considered that the amount of the developer supplied to the developing sleeve becomes insufficient. In this case, a part of the developing sleeve may be not coated thereon with the developer, or a phenomenon that coating is failed (hereinafter referred to as a coating failed phenomenon) may occur.

Switching an image forming speed upon printing a thick paper and so on is one of the factors that the developer surface height varies.

In an image forming apparatus having a low-speed mode in which when a thick paper or the like is printed, image formation is performed at a lower speed than a normal image forming speed (normal mode), the rotation speeds of the developing sleeve and the conveying screw are generally reduced corresponding to a change to the low-speed mode. In such an image forming apparatus, after printing is performed in the normal mode, when the image forming mode is switched to the low-speed mode to perform printing, the coating failed phenomenon may occur due to the developer surface height variation only immediately after switching to the low-speed mode.

When the image forming mode is switched to the low-speed mode, the respective rotary drives are performed at the rotation speed for the low-speed mode. When the developing sleeve is rotated at the rotation speed for the low-speed mode, the coating amount of the developer on the developing sleeve may be different from that in the normal mode. This is because the conveying property of the developer is changed by the rotation speed of the developing sleeve. The cause that the conveying property of the developer is changed by the rotation speed of the developing sleeve is considered as follows.

The developer on the developing sleeve is caught by concaves and convexes formed on a surface of the developing sleeve by blast processing and so on, whereby the developer is conveyed in the rotating direction. Thus, the conveying property is changed by the degree that the developer is caught by the concaves and convexes on the sleeve surface.

When the rotation speed of the developing sleeve is relatively low, the developer is firmly caught by the concaves and convexes on the sleeve surface. Accordingly, the conveying property is high. Meanwhile, when the rotation speed of the developing sleeve is high to some extent, the developer is less likely to be caught by the concaves and convexes on the sleeve surface. Consequently, a slip occurs.

As described above, in comparison with the normal mode in which the developing sleeve speed is high, in the low-speed mode in which the developing sleeve speed is low, the slip phenomenon is less likely to occur. Accordingly, the developer coating amount on the developing sleeve is increased.

The slip phenomenon more notably occurs when the developing sleeve surface is worn by the use for long periods to reduce the surface roughness. Thus, as the developing sleeve is used for longer periods, the developer coating amount is more widely different between the normal mode and the low-speed mode.

When the developer coating amount on the developing sleeve increases in the low-speed mode, the amount of the developer conveyed from the developing chamber to the agitation chamber by the developing sleeve increases more than in the normal mode. Thus, the developer amount in the developing chamber is temporarily reduced in comparison with the normal mode, and the developer surface height is reduced. Accordingly, if the image forming mode is switched from the normal mode to the low-speed mode when the developer surface height in the developing chamber is low from the beginning, the developer surface is further lowered immediately after switching to the low-speed mode by the above reasons. As a result, the coating failed phenomenon of the developing sleeve may occur at a downstream portion of the first conveying screw 125 (the portion A of FIG. 14).

As described above, the developer surface height in the developing chamber is lowered immediately after the image forming mode is switched to the low-speed mode, and meanwhile, the developer amount in the agitation chamber 124 is increased. Consequently, the amount of the developer drawn up from the agitation chamber 124 to the developing chamber 123 is increased. After a period of time, the developer amount in the developing chamber 123 is recovered, and the coating failed phenomenon does not occur. Namely, the coating failed phenomenon most likely occurs immediately after switching to the low-speed mode.

SUMMARY OF THE INVENTION

Thus, the present invention provides an image forming apparatus which performs image formation that can control a developer surface height variation in a development container even if the speed of a conveying member is switched with switching of a process speed.

An image forming apparatus for achieving the above object includes an image bearing member, a developer bearing member bearing and conveying a developer to a development position facing the image bearing member, a first chamber from which the developer is supplied to the developer bearing member, a second chamber in which the developer after development in the developer bearing member is collected, a conveying member circulating and conveying the developer in the first and second chambers, an executing portion which can make the image forming apparatus execute a first mode in which image formation is performed at a first image forming speed and a second mode in which image formation is performed at a second image forming speed lower than the first image forming speed, and a controlling portion which, in case that a mode is switched between the first mode and the second mode, gradually changes a target drive speed of the conveying member so that the drive speed of the conveying member is gradually changed from the drive speed of the conveying member in the mode before switching to the drive speed in a steady state in the mode after switching.

Further features of the present invention will become apparent from the following description of exemplary embodiments with reference to the attached drawings.

BRIEF DESCRIPTION OF THE DRAWINGS

FIG. 4 is a table showing a rotation speed of each rotating member in each image forming mode according to the first embodiment;

FIG. 12 is a table showing a relationship with a predetermined time till when the rotation speed is returned to a steady state with respect to the integrated rotation time according to the second embodiment;

DESCRIPTION OF THE EMBODIMENTS

First Embodiment

Figure 1:
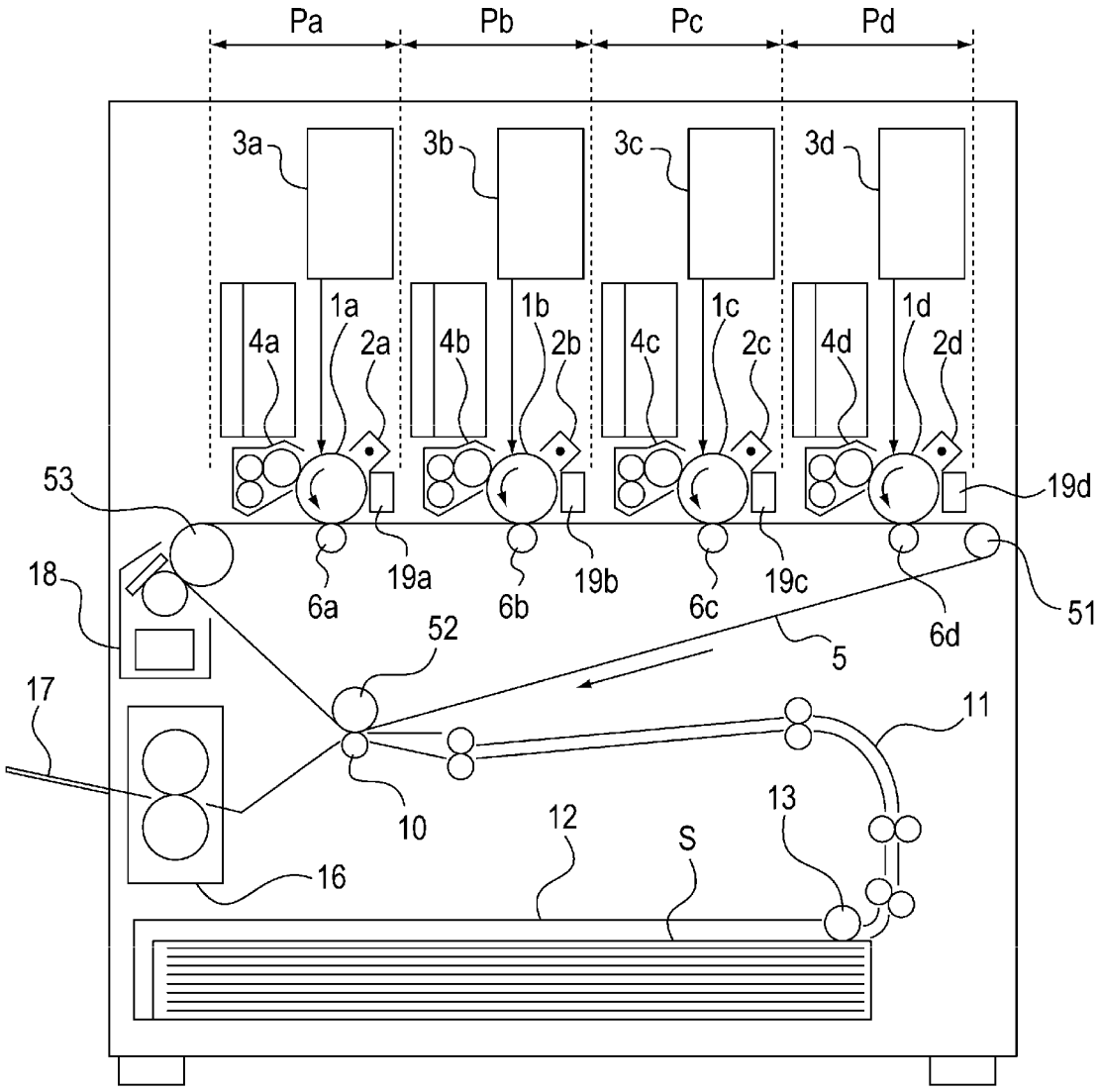
FIG. 1 is a schematic cross-sectional view of an image forming apparatus according to a first embodiment.

A first embodiment will be described with reference to the drawings. FIG. 1 is a schematic cross-sectional view of an image forming apparatus of the first embodiment. In FIG. 1, a full-color image forming apparatus employing an electrophotographic system is illustrated as one embodiment of an image forming apparatus to which the present invention is applicable.

The image forming apparatus includes four image forming portions P (Pa, Pb, Pc, and Pd). The image forming portions Pa to Pd include photosensitive drums 1 (1*a*, 1*b*, 1*c*, and 1*d*) as image bearing members. The photosensitive drum 1 is a drum-shaped electrophotographic photoreceptor rotating in a counterclockwise direction in FIG. 1.

The image forming portion has around the photosensitive drum 1 electric chargers 2 (2*a*, 2*b*, 2*c*, and 2*d*), laser beam scanners 3 (3*a*, 3*b*, 3*c*, and 3*d*), development devices 4 (4*a*, 4*b*, 4*c*, and 4*d*), and cleaning members 19 (19*a*, 19*b*, 19*c*, and 19*d*). Primary transfer rollers 6 (6*a*, 6*b*, 6*c*, and 6*d*) performing primary transfer are arranged through an intermediate transfer belt 5. Hereinafter, since the reference numerals a to d have the same configuration in each image forming portion, they are not described except for especially required cases.

Next, an image forming sequence in a normal mode in the entire image forming apparatus having the above constitution will be described. In the normal mode (first mode), image formation is performed at a first image forming speed. In the image forming apparatus of the present embodiment, at least another mode can be executed. In the image forming apparatus, there is a low-speed mode (second mode) in addition to the normal mode. In the second mode, image formation is performed at a second image forming speed lower than the speed in the normal mode.

In the image forming apparatus of the present embodiment, image formation is performed in the "normal mode" in normal image formation. In the normal mode, the circumferential velocity (process speed) of the photosensitive drum 1 is 255 mm/sec in a counterclockwise direction. In the image forming apparatus of the present embodiment, image formation is performed at the two image forming speeds as described above. For example, when a thick paper or the like is printed, image formation is performed in the low-speed mode in which the speed is one half of the speed in the normal mode. Namely, the process speed in the low-speed mode is 127.5 mm/sec.

First, the photosensitive drum 1 is uniformly charged by the electric charger 2. The uniformly charged photosensitive drum 1 is scanned and exposed by a laser beam emitted from the laser beam scanner 3 and modulated by an image signal. The surface potential on the photosensitive drum 1 is changed in an image portion, and an electrostatic latent image is formed on the photosensitive drum 1.

The laser beam scanner 3 incorporates a semiconductor laser. The semiconductor laser is controlled corresponding to a document image information signal output from a manuscript reading apparatus having a photoelectric conversion element such as a CCD and emits a laser beam.

The developer is supplied to the electrostatic latent image on the photosensitive drum 1 by the development device 4. Then, a visible image, that is, a toner image is formed on the photosensitive drum 1. In the present embodiment, the development device 4 employs a two-component development method using a developer containing a mixture of carrier and toner.

The above process is performed for each of the image forming portions P (Pa, Pb, Pc, and Pd). According to this constitution, toner images of four colors of yellow, magenta, cyan, and black are formed on the photosensitive drums 1.

The intermediate transfer belt 5 (intermediate transfer member) is arranged under each of the image forming portions P. The endless intermediate transfer belt 5 is stretched between stretching rollers 51 to 53 and conveyed.

The toner image on the photosensitive drum 1 is transferred to the intermediate transfer belt 5 by the primary transfer roller 6 (primary transfer member). The transfer is performed by each of the image forming portions P, whereby the toner images of four colors of yellow, magenta, cyan, and black are superimposed on the intermediate transfer belt 5, and a full color image is formed. The toner remaining on the photosensitive drum 1 without being transferred is collected by the cleaning member 19.

The full color image formed on the intermediate transfer belt 5 is transferred to a transfer material S in a secondary transfer portion including a secondary transfer roller 10 (secondary transfer member) facing the stretching roller 52. The transfer material S is taken from a sheet cassette 12 to be conveyed to the secondary transfer portion via a feed roller 13 and a feeding guide 11. The full color image on the intermediate transfer belt 5 may not be secondary-transferred and remain (as residual toner) on the surface of the intermediate transfer belt 5. The residual toner is collected by an intermediate transfer belt cleaning member 18.

Meanwhile, the transfer material S to which the toner image is secondary-transferred is sent to a fixer 16 in which fixing is performed by pressing of a heat roller. The image on the transfer material S is fixed, and the transfer material S is discharged to a discharge tray 17.

In the present embodiment, although the photosensitive drum 1 which is a normally used drum-shaped organic photoreceptor is used as an image bearing member, the image bearing member is not limited to the photosensitive drum 1. For example, an inorganic photoreceptor such as an amorphous silicon photoreceptor may be used. Further, a belt-shaped photoreceptor may be used. Furthermore, the charging method, the transfer method, the cleaning method, and the fixing method are not limited to the above methods.

Figure 2:
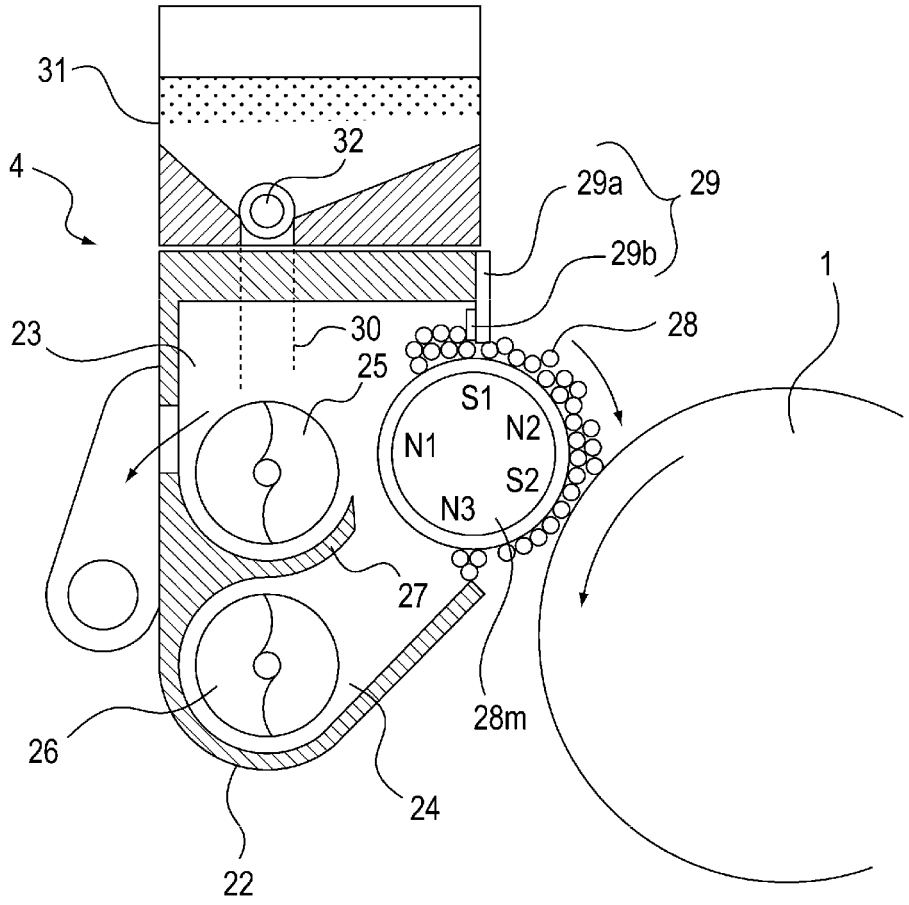
FIG. 2 is a cross-sectional view in a direction perpendicular to a rotation shaft in a development device according to the first embodiment.
Figure 3:
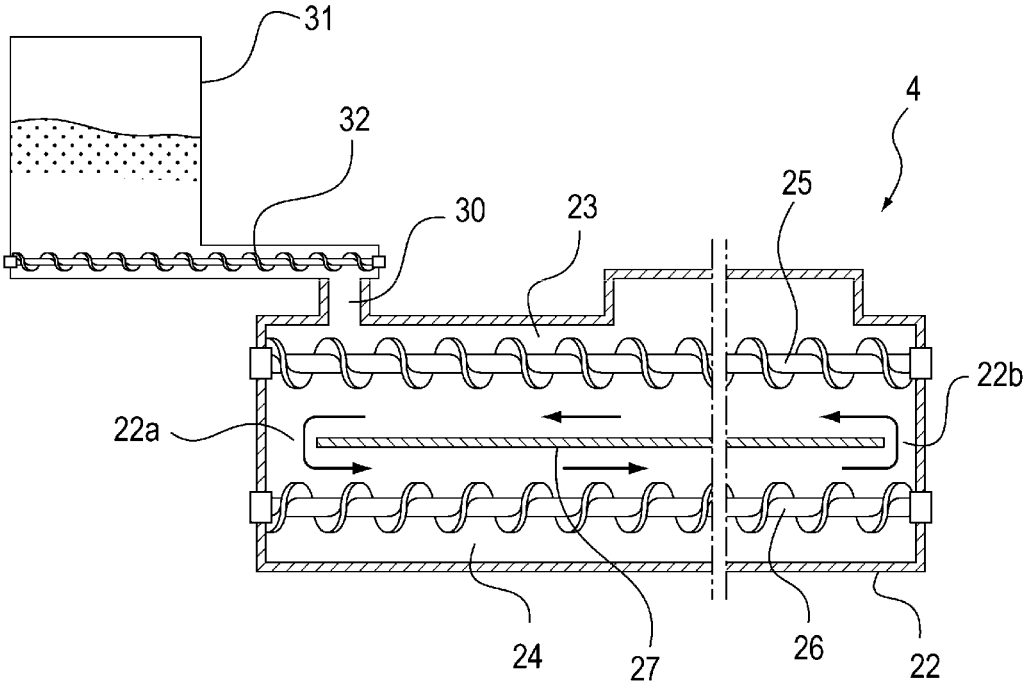
FIG. 3 is a cross-sectional view in a direction parallel to the rotation shaft in the development device according to the first embodiment.

Next, the operation of the development device 4 of the present embodiment will be described with reference to FIGS. 2 and 3. FIG. 2 is a cross-sectional view in a direction perpendicular to a rotation shaft in the development device 4 of the first embodiment. FIG. 3 is a cross-sectional view in a direction parallel to the rotation shaft in the development device 4 of the first embodiment. The development device 4 of the present embodiment is a so-called vertical agitation type development device.

As illustrated in FIGS. 2 and 3, the development device 4 includes a vertical development container 22 in which a developing chamber 23 and an agitation chamber 24 are arranged vertically. The development container 22 stores therein a two-component developer containing toner and carrier as a developer. As illustrated in FIG. 2, the development container 22 includes a developing sleeve 28 (developer bearing member) and a bristle cutting member 29 which carries out bristle cutting for controlling the height of bristles of the developer supported on the developing sleeve 28. Next, both the members will be described in detail.

The developing sleeve 28 carries and conveys the developer to a development position facing the photosensitive drum 1. The diameter of the developing sleeve 28 is 20 mm, the diameter of the photosensitive drum 1 is 40 mm, and the most proximate area between the developing sleeve 28 and the photosensitive drum 1 is a distance of about 380 μm. Consequently, it is set so that development can be performed in such a state that the developer conveyed to a developing portion is in contact with the photosensitive drum 1. The developing sleeve 28 is formed of a nonmagnetic material such as aluminum and stainless and includes a magnet roller 28*m*, which is a magnetic field generating member, in an irrotational state.

The magnet roller 28*m* has a development pole S2 arranged to face the photosensitive drum 1, a magnetic pole S1 arranged to face the bristle cutting member 29, a magnetic pole N1 arranged between the magnetic poles S1 and S2, and magnetic poles N2 and N3 arranged to face the developing chamber 23 and the agitation chamber 24, respectively. The rotation number of the developing sleeve 28 in the normal image formation (normal mode) is set to 366 rpm (the circumferential velocity against the photosensitive drum=150%).

The developing sleeve 28 carries the developer whose layer thickness is controlled by bristle cutting of a magnetic brush by the bristle cutting member 29. The developer is conveyed to a development area facing the photosensitive drum 1 to be supplied to the electrostatic latent image formed on the photosensitive drum 1. According to this constitution, the electrostatic latent image is developed to become a toner image.

The bristle cutting member 29 is a blade-like member controlling the layer thickness of the developer. The bristle cutting member 29 includes a nonmagnetic member 29*a*, which is formed of plate-shaped aluminum extending along the axis line in the longitudinal direction of the developing sleeve 28, and a magnetic member 29*b* formed of a steel material. The bristle cutting member 29 is arranged on the upstream side in the developing sleeve rotating direction from the photosensitive drum 1.

When the developer is supplied to the photosensitive drum 1, the toner and the carrier of the developer pass through between the front end of the bristle cutting member 29 and the developing sleeve 28 to be sent to the development area. A gap between the bristle cutting member 29 and the surface of the developing sleeve 28 is adjusted, whereby the amount of cutting the bristles of the developer magnetic brush supported on the developing sleeve 28 is controlled. The bristle cutting amount is controlled as described above, whereby the amount of the developer to be conveyed to the development area is adjusted to a desired amount.

In the present embodiment, by virtue of the bristle cutting member 29, the developer coating amount per a unit area on the developing sleeve 28 is controlled to 30 mg/cm$^2$. The gap between the bristle cutting member 29 and the developing sleeve 28 is preferably set to be 200 to 1000 μm and more preferably 400 to 700 μm. In the present embodiment, the gap is set to 580 μm.

As illustrated in FIGS. 2 and 3, the inside of the development container 22 at its substantially central portion is vertically partitioned by a bulkhead 27 extending in a horizontal direction. Thus, the developing chamber 23 is provided above the bulkhead 27, and the agitation chamber 24 is provided under the bulkhead 27. The developer is stored in the developing chamber 23 and the agitation chamber 24.

The development container 22 has two rotating members agitating and conveying the developer. One of the two rotating members is a first conveying screw 25 (supply-agitation member) arranged in the developing chamber 23, and the other is a second conveying screw 26 (collect-agitation member) arranged in the agitation chamber 24. The first conveying screw 25 and the second conveying screw 26 are arranged substantially parallel to each other. In the present embodiment, both the first and second conveying screws 25 and 26 have such a shape that the outer diameter Φ is 20 mm, the axis diameter is 6 mm, and the pitch is 25 mm, and the rotation speed in the normal image formation (normal mode) is set to 380 rpm.

The developer is conveyed in the development container 22 by the two conveying screws as follows. As illustrated in FIG. 3, when the first conveying screw 25 is rotated, the developer in the developing chamber 23 is conveyed in one direction along the axis line direction. As illustrated in FIG. 2, the developer is supplied to the developing sleeve 28 while being conveyed in the developing chamber 23. The developer reaching the left end of the developing chamber 23 in FIG. 3 moves from an opening 22*a*, which is in communication with the agitation chamber 24, to the agitation chamber 24.

In the agitation chamber 24, the second conveying screw 26 rotates in the opposite direction of the first conveying screw 25. Thus, the second conveying screw 26 conveys the developer in the agitation chamber 24 in the opposite direction of the conveying direction in the developing chamber 23. The developer reaching the right end of the agitation chamber 24 in FIG. 3 moves from an opening 22*b*, which is in communication with the developing chamber 23, to the developing chamber 23. Accordingly, the developer is circulated between the developing chamber 23 and the agitation chamber 24 through the openings 22*a* and 22*b* at the both ends of the bulkhead 27.

Next, a method of supplying the developer will be described with reference to FIGS. 2 and 3.

A hopper 31 (toner supplying member) storing a two-component developer for supply in which toner and carrier are mixed at the weight ratio of 8:2 is arranged at the upper portion of the development device 4. The hopper 31 includes a screw-like supply screw 32 provided at the lower portion. The supply screw 32 is extended to a developer supply opening 30 whose one end is provided at the front end of the development device 4.

The toner of the amount corresponding to the amount consumed by the image formation is sent from the hopper 31 through the developer supply opening 30 to be supplied to the development container 22 by the rotational force of the supply screw 32 and the gravity of the developer. The carrier mixed with the toner is supplied with the toner. The developer is supplied from the hopper 31 to the development device 4 as described above.

The supply amount of the developer is roughly determined by the rotation number of the supply screw 32. The rotation number is determined by a controlling portion to be described later. As a method of controlling the toner supply amount, there have been known various methods such as a method of optically or magnetically detecting the toner concentration of the two-component developer and a method of developing a reference latent image on the photosensitive drum 1 and detecting a density of the toner image. In the present embodiment, the method is not limited, and any one of the methods may be suitably selected.

Next, as the feature of the present embodiment, a developing sleeve 28 and a drive control method of the two conveying members which are the first and second conveying screws 25 and 26 circulating and conveying the developer will be described in detail.

The development device 4 in the present embodiment has a sleeve drive motor M1 (carrier driving portion) driving the developing sleeve 28 and a screw drive motor M2 (agitation member driving portion) driving the first and second conveying screws 25 and 26. The sleeve drive motor M1 and the screw drive motor M2 are separate motors. In the present embodiment, an independent driving method in which the motors M1 and M2 are each independently driven is adopted.

As described above, in the present embodiment, there is not only the normal mode in which image formation is performed at a normal speed but a low-speed mode used when a thick sheet or the like is printed. The speed in the steady state in each mode is set as illustrated in FIG. 4. FIG. 4 is a diagram illustrating the rotation speed of each rotating member in each image forming mode according to the first embodiment. The steady state in the present embodiment means a state in which the circulation of the developer is stable in each image forming mode except for immediately after the image forming mode is switched.

As illustrated in FIG. 4, in the low-speed mode, as the rotation speed (process speed) of the photosensitive drum 1 is reduced to half, the rotation speed of the developing sleeve 28 is reduced at the same speed ratio as the photosensitive drum 1. Meanwhile, the rotation speed of the first and second conveying screws 25 and 26 is reduced at a different speed ratio from the photosensitive drum 1 and the developing sleeve 28.

In the vertical agitation type development device 4, the amount of the developer conveyed from the agitation chamber 24 to the developing chamber 23 through the opening 22*b* of the bulkhead 27 substantially depends on the rotation speed of the first and second conveying screws 25 and 26.

Specifically, when the rotation speed of the first and second conveying screws 25 and 26 is reduced, the amount of the developer conveyed to the developing chamber 23 is reduced to the reduced speed ratio or more in fact. For example, when the rotation speed of the developing sleeve 28 is reduced to half in the low-speed mode, the rotation speed of the first and second conveying screws 25 and 26 is reduced to half as in the developing sleeve 28. This causes such a phenomenon that the amount of the developer conveyed to the developing chamber 23 per a unit time is reduced to half or less. Consequently, the developer surface height in the developing chamber 23 is lower than the developer surface height in the normal mode.

In order to avoid the phenomenon, in the present embodiment, the rotation of the developing sleeve 28 and the rotation of the first and second conveying screws 25 and 26 are independently driven. In addition, the value of the speed reduction ratio in the low-speed mode with respect to the normal mode of the first and second conveying screws 25 and 26 is larger than the value of the speed reduction ratio in the low-speed mode with respect to the normal mode of the developing sleeve 28. Consequently, the developer surface height is substantially constant in the normal mode and the low-speed mode.

In the present embodiment, if the rotation speed of the first and second conveying screws 25 and 26 is rapidly switched immediately after switching from the normal mode to the low-speed mode, the developer surface height may not be stable. Thus, in the present embodiment, a control for maintaining the constant developer surface height is performed in addition to the above control.

Specifically, the rotation speed is high relative to the rotation speed in the steady state in the low-speed mode for a predetermined time from immediately after the image forming mode is switched from the normal mode to the low-speed mode.

Figure 5:
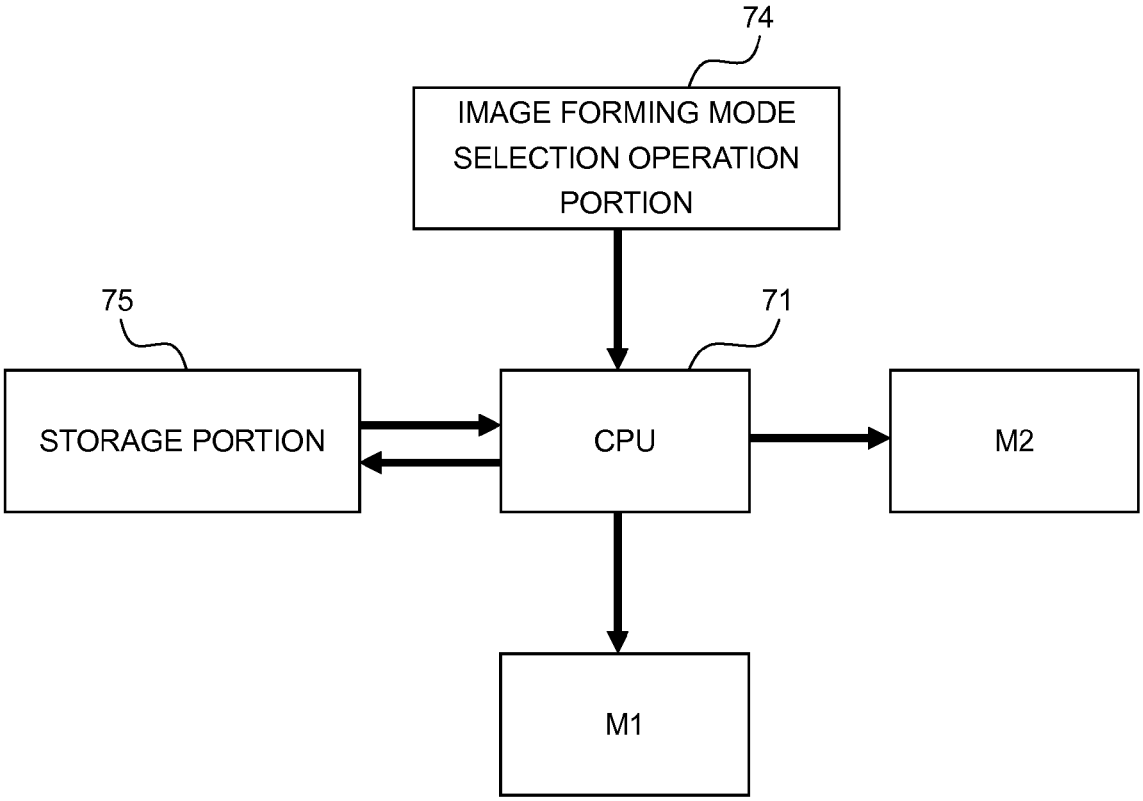
FIG. 5 is a block diagram according to a control according to the first embodiment.
Figure 6:
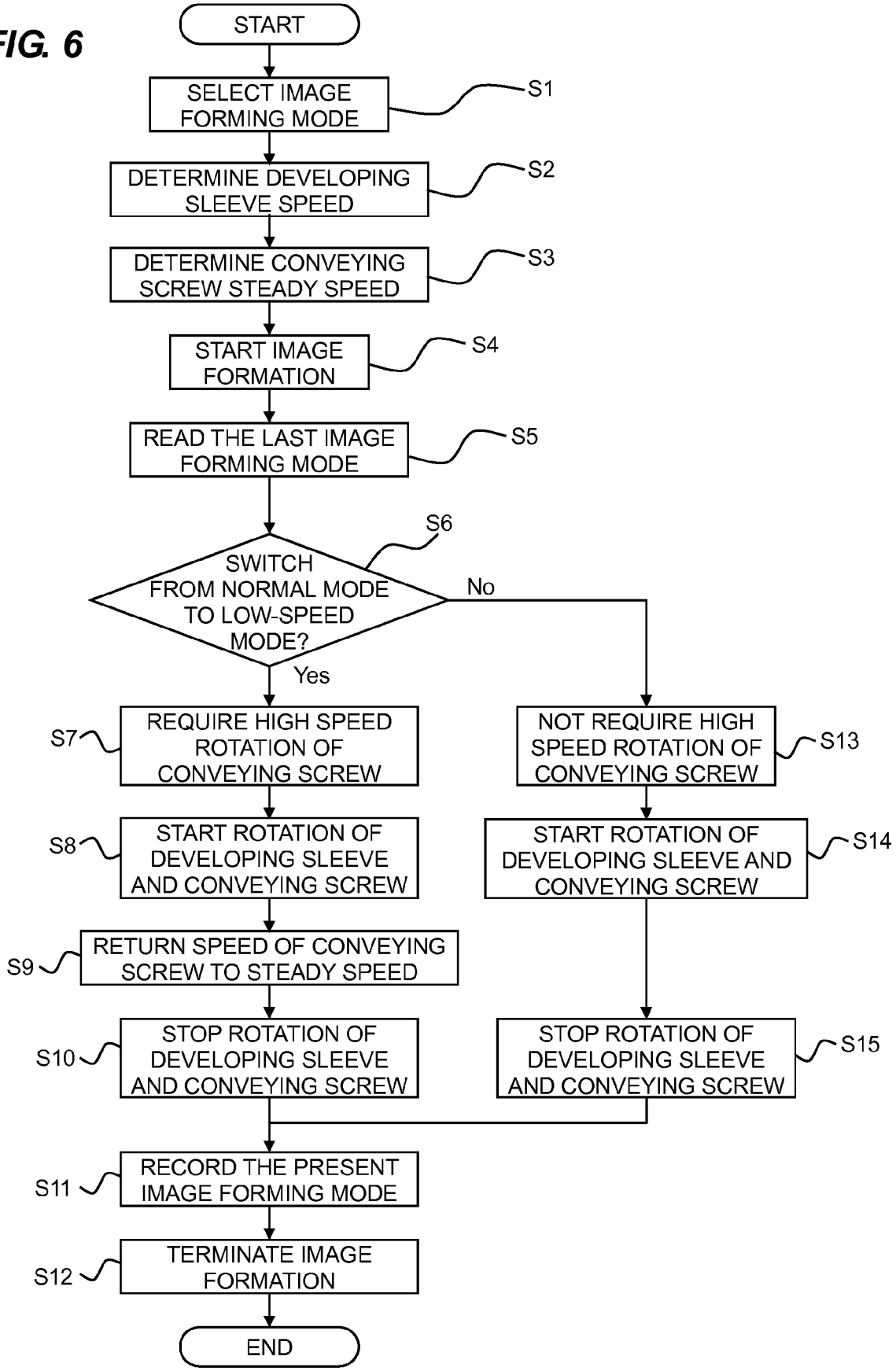
FIG. 6 is a flow chart according to the control according to the first embodiment.

The control of the rotation of the first and second conveying screws 25 and 26 will be described with reference to FIGS. 5 and 6. FIG. 5 is a block diagram according to a control according to the first embodiment. FIG. 6 is a flow chart according to the control according to the first embodiment.

As illustrated in FIG. 5, a CPU 71 (controlling portion) controls a storage portion 75, the sleeve drive motor M1, and the screw drive motor M2 corresponding to information of an image forming mode selection operation portion 74 (executing portion). Next, a procedure of the control according to the first embodiment will be described with reference to FIG. 6.

Before start of the image forming operation, a user operates to switch the image forming mode selection operation portion 74 based on the type of a sheet to be printed, whereby the image forming mode is selected from the normal mode or the low-speed mode, and the selected mode can be executed. The information selected by the image forming mode selection operation portion 74 is sent to the CPU 71. The CPU 71 recognizes the selected image forming mode to determine the image forming mode (S1).

When the image forming mode is determined, the developing sleeve speed corresponding to the image forming mode is determined (S2). Further, the speed in the steady state of the conveying screw is determined (S3). Then, the image forming operation is started (S4).

The CPU 71 reads the image forming mode in the last printing stored in the storage portion 75 (S5). Then, the image forming mode in the last printing is compared with the image forming mode executed when image formation is started. As a result of the comparison between the image forming modes, it is confirmed whether the last image forming mode is the normal mode and the present image forming mode is the low-speed mode (S6).

When the last image forming mode is the normal mode and the present image forming mode is switched to the low-speed mode, it is determined that the developer surface height in the developing chamber is substantially reduced (S7). Thus, during a predetermined time from the start of the rotation of the first and second conveying screws 25 and 26, the first and second conveying screws 25 and 26 are rotated at a speed higher than the rotation speed of the second conveying screw 26 in the steady state in the low-speed mode (S8).

After a lapse of a predetermined time, the rotation speed of the second conveying screw 26 is the rotation speed in the steady state in the low-speed mode (S9). When the image formation onto the transfer material S is completed, the developing sleeve 28 and so on are stopped (S10). Then, the present image forming mode is recorded in the storage portion 75 (S11), and the image forming operation is terminated (S12).

Meanwhile, in the determination in S6, when the last image forming mode is not the normal mode and the present image forming mode is not switched to the low-speed mode, high-speed rotation is not required during a predetermined time from the start of the rotation of the first and second conveying screws 25 and 26 (S13). Thus, the developing sleeve 28 and so on are rotated as usual (S14). When the image formation onto the transfer material S is completed, the developing sleeve 28 is stopped (S15). Thereafter, as described above, the present image forming mode is recorded in the storage portion 75 (S11), and the image forming operation is terminated (S12). The information of the present image forming mode is utilized in the next image formation.

Figure 7:
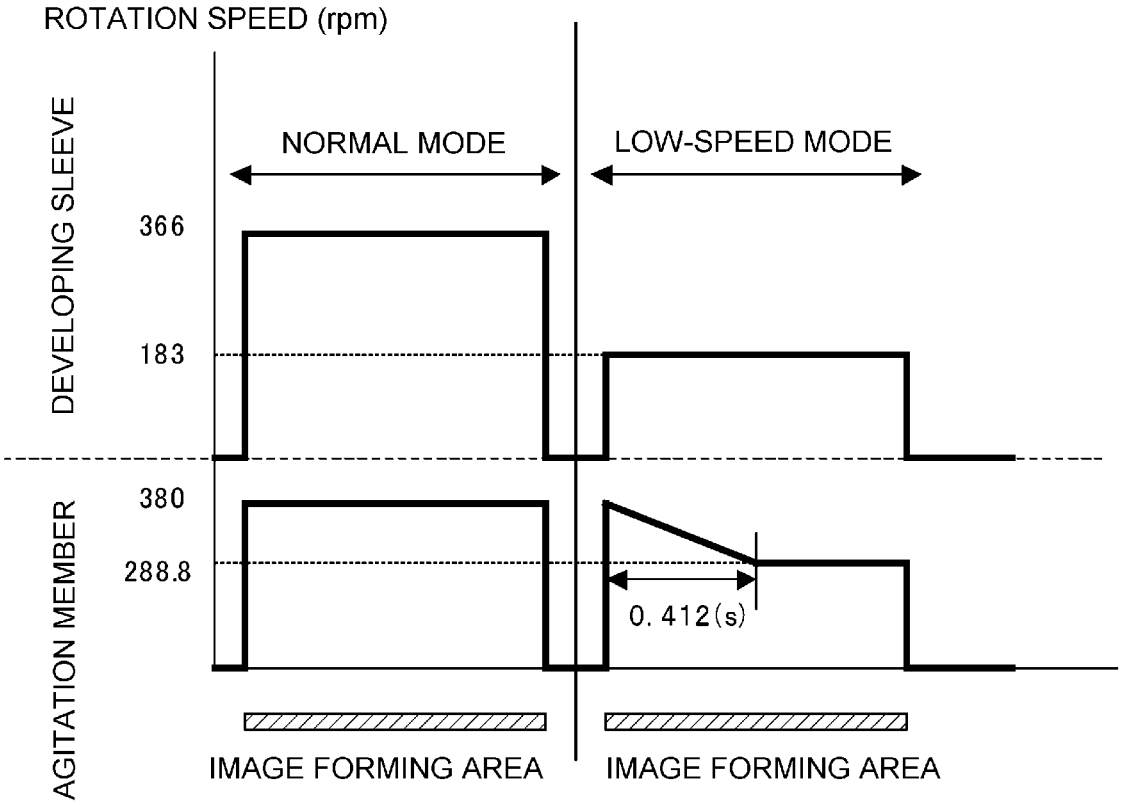
FIG. 7 is an image view of switching the rotation speed according to the first embodiment.

In the case where the image forming mode shifts from the normal mode to the low-speed mode in the determination in S6 of FIG. 6, the state of switching the rotation speed will be described with reference to FIG. 7. FIG. 7 is an image view of switching the rotation speed according to the first embodiment.

When a drive start signal is output from the CPU 71, the sleeve drive motor M1 and the screw drive motor M2 start to rotate, and, at the same time, the rotation number is controlled by the CPU 71.

For the rotation number of the developing sleeve 28, as illustrated in FIG. 7, the developing sleeve 28 is rotated with a value (183 rpm in the present embodiment) corresponding to the speed reduction ratio of the photosensitive drum 1 in the low-speed mode with respect to the normal mode.

Meanwhile, the rotation numbers of the first and second conveying screws 25 and 26 are controlled by the CPU 71 as follows. The rotation number of the first and second conveying screws 25 and 26 immediately after start of the rotation is 380 rpm the same as the rotation speed in the normal mode. The rotation speed (target drive speed) in the steady state in the low-speed mode is 288.8 rpm. In the present embodiment, the rotation speed ratio of a conveying member in a second mode with respect to a first mode is set to be larger than the rotation speed ratio of the photosensitive drum 1 in the second mode with respect to the first mode.

At that time, in the present embodiment, as illustrated in FIG. 7, when the rotation speed is shifted to the target drive speed from the start of driving, the rotation speed is changed to be linearly and gradually reduced. After a lapse of a predetermined time, the CPU 71 controls the speed of the screw drive motor M2 so that the rotation speed is the rotation speed in the steady state. In the present embodiment, the predetermined time (transition time) is 0.412 sec.

Even if the developer amount in the developing chamber 23 is reduced immediately after the image forming mode is switched to the low-speed mode, the rotation speed of the first and second conveying screws 25 and 26 is maintained to be high for a predetermined time, whereby the developer surface height in the downstream portion of the developing chamber can be maintained to be high. Thus, the occurrence of the coating failed phenomenon can be prevented.

In the comparison between the last image forming mode and the present image forming mode, when both the modes are the normal modes, or when both the modes are the low-speed modes, the rotation speed is not switched, and a balance of circulation of the developer is not changed. In those cases, the rotation speed is not required to be higher than the rotation speed in the steady state of the first and second conveying screws 25 and 26, and the rotation speed is controlled to be 288.8 rpm as the speed in the steady speed from immediately after the start of rotation.

Figure 8:
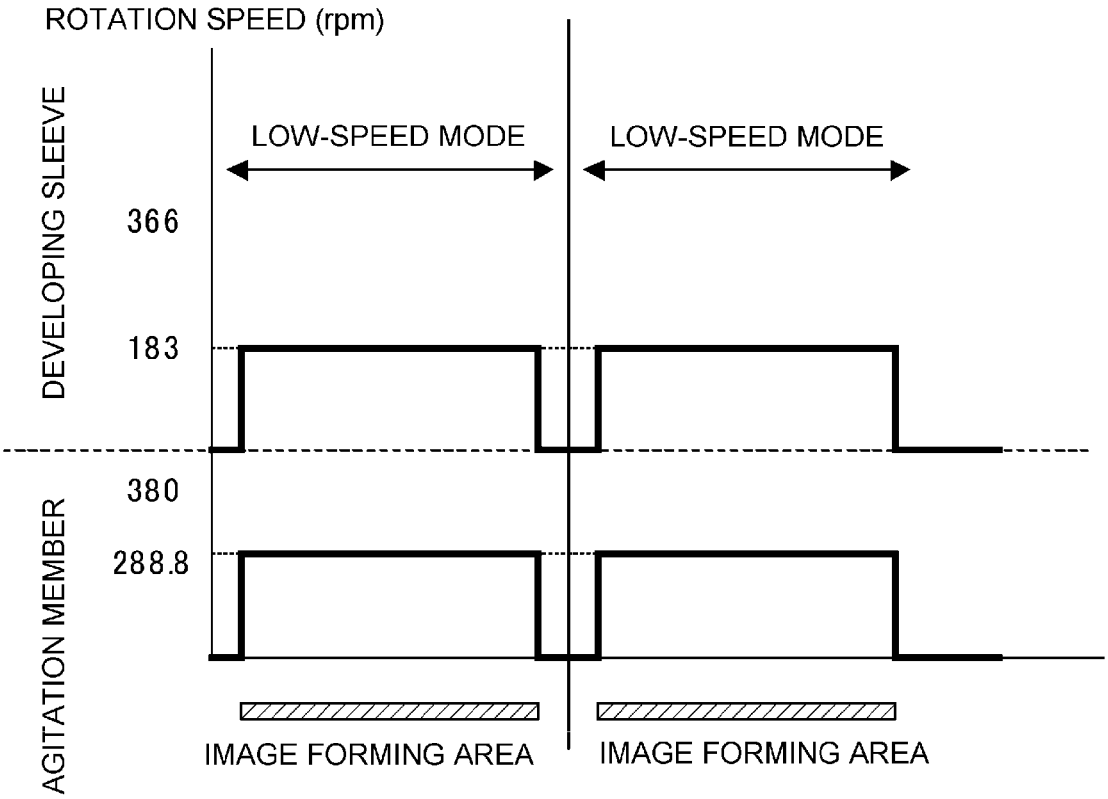
FIG. 8 is an image view when the rotation speed is not switched in the first embodiment.

For example, a case where the low-speed mode continues from the last image formation to the present image formation will be described with reference to FIG. 8. FIG. 8 is an image view when the rotation speed is not switched in the first embodiment.

As illustrated in FIG. 8, when the last image forming mode is the low-speed mode as in the present image forming mode, the rotation speed of the first and second conveying screws 25 and 26 in the present image formation is kept to 288.8 rpm as in the last image formation.

In the comparison between the last image forming mode and the present image forming mode, when the last image formation is in the low-speed mode and the present image formation is in the normal mode, there occurs a phenomenon opposite to the phenomenon occurring when the image forming mode is switched from the normal mode to the low-speed mode. Namely, the developer surface height in the developing chamber is temporarily increased immediately after the switching of the rotation speed.

In this case, since the coating failed phenomenon is rather less likely to occur, a special control is unnecessary, and also in this case, the control of the high-speed rotation of the first and second conveying screws 25 and 26 is not required to be performed. However, it is desirable that the developer amount in the developer chamber is controlled to be constant as much as possible.

Accordingly, the drive of the first and second conveying screws 25 and 26 may be controlled so that the amount of the developer conveyed to the developing chamber immediately before the image forming mode is switched from the low-speed mode to the normal mode is reduced, or the amount of the developer conveyed to the agitation chamber is increased.

Specifically, the driving speed of the first and second conveying screws 25 and 26 immediately after the switching of the image forming mode is controlled to gradually become fast (high). This is because the slower the driving speed of the first and second conveying screws 25 and 26 is, the smaller the amount of the developer drawn up from the agitation chamber to the developing chamber becomes, and consequently, the amount of the developer conveyed to the developing chamber can be reduced.

In order to simply maintain the high developer surface height of the developing chamber 23 in the low-speed mode, it is considered that the speed of the first and second conveying screws 25 and 26 is kept to 380 rpm not only immediately after the switching of the speed but in the steady state. However, in this case, the developer surface height of the developing chamber 23 is excessively increased, so that the developer surface height near a developer outlet is increased. As a result, the discharge amount of the developer is increased, and the developer amount in the development device 4 is substantially reduced. Thus, it is effective that the control is performed so as to switch the speed as in the present embodiment.

In the present embodiment, the rotation speed in the normal mode of the first and second conveying screws 25 and 26 is 380 rpm, and the predetermined time of returning the rotation speed to the steady speed is 0.412 sec, but the present invention is not limited thereto. The rotation speed and the predetermined time can be suitably set to optimum numerical values according to the configuration of the development device 4 and the type of the developer in use.

In the present embodiment, as illustrated in FIG. 7, the speed of the first and second conveying screws 25 and 26 is linearly reduced when returned to the speed in the steady state; however, the present invention is not limited thereto. Namely, the speed may be controlled to be reduced by other methods. For example, the speed may be controlled to be reduced in a stepwise manner or nonlinearly reduced.

In the present embodiment, although the vertical agitation type development device in which the first and second conveying screws 25 and 26 are arranged vertically has been described, the present invention is not limited thereto, but applicable to a horizontal agitation type development device as long as it is a function separating type development device. The function separating type development device means a development device including a first chamber from which the developer is supplied to the developing sleeve and a second chamber in which the developer after development provided in development on the developing sleeve is collected.

As described above, the control as in the present embodiment is performed, whereby in the development device using the vertical agitation type development device, the high developer surface height can be maintained even in such a state that the developer amount in the developing chamber is small immediately after the image forming mode is switched from the normal mode to the low-speed mode. Thus, the coating failed phenomenon due to a supply shortage of the developer to the developing sleeve is prevented, and the constantly stable coating state can be realized.

Second Embodiment

Figure 9:
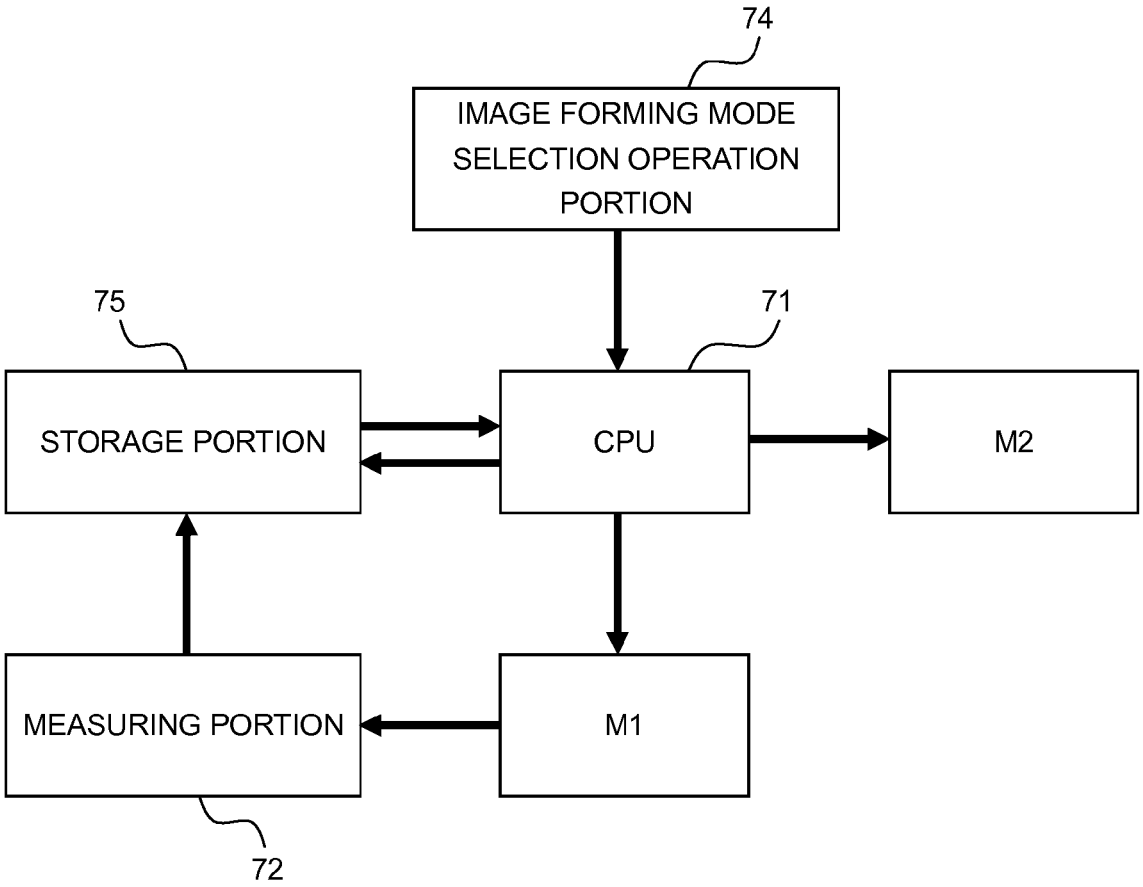
FIG. 9 is a block diagram according to a control according to a second embodiment.
Figure 10:
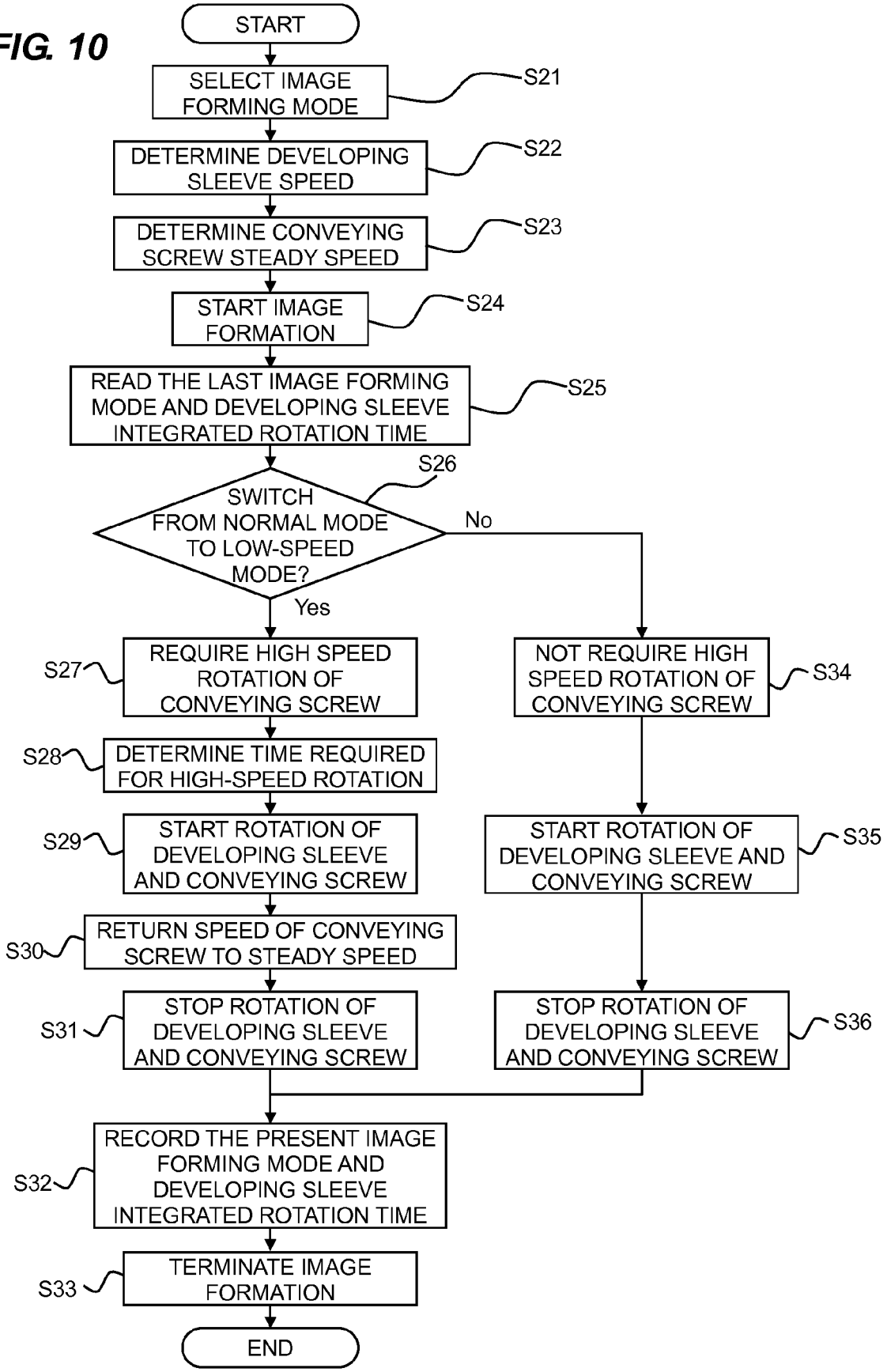
FIG. 10 is a flow chart according to the control according to the second embodiment.

The second embodiment will be described with reference to the drawings. FIG. 9 is a block diagram according to a control according to a second embodiment. FIG. 10 is a flow chart according to the control according to the second embodiment.

The components similar to those in the first embodiment are denoted by the same reference numerals, and the description will not be repeated. In the second embodiment, it is characterized that immediately after the image forming mode is switched from the normal mode to the low-speed mode, the time from when the rotation speed of a conveying screw is brought into a high-speed rotation state till when the high-speed rotation state is returned to a steady state is changed corresponding to a durable state of a developing sleeve 28.

As illustrated in FIG. 9, the CPU 71 controls a storage portion 75, a sleeve drive motor M1, and a screw drive motor M2 corresponding to information of an image forming mode selection operation portion 74. In the present embodiment, the CPU 71 performs control based on the information of the sleeve drive motor M1. Specifically, the CPU 71 has a measuring portion 72 which measures the rotation time of the sleeve drive motor M1 and integrates the rotation time measured by the measuring portion 72 to store the integrated rotation time in the storage portion 75. Next, a procedure of the control according to the second embodiment will be described with reference to FIG. 10.

The control before start of the image forming operation is similar to that in the first embodiment (S21 to S24).

The CPU 71 reads the image forming mode in the last printing stored in the storage portion 75 and, at the same time, reads the integrated rotation time of the developing sleeve 28

(S25). The integrated rotation time of the developing sleeve 28 means the total rotation time from the start of the use of the developing sleeve 28 to the present.

Next, the image forming mode in the last printing is compared with the image forming mode executed when the image formation is started. As a result of the comparison between the image forming modes, it is confirmed whether the last image forming mode is the normal mode and the present image forming mode is the low-speed mode (S26).

When the last image forming mode is the normal mode and the present image forming mode is switched to the low-speed mode, it is determined that the developer surface height in the developing chamber is substantially reduced (S27). The length of the time of rotating the first and second conveying screws 25 and 26 at a speed higher than the speed in the steady state immediately after the image forming mode is switched from the normal mode to the low-speed mode is calculated from the read integrated rotation time of the developing sleeve 28 (S28). Then, during a predetermined time from the start of the rotation of the first and second conveying screws 25 and 26, the developing sleeve 28 is rotated at a speed higher than the rotation speed of the second conveying screw 26 in the steady state in the low-speed mode (S29).

After a lapse of a predetermined time, the rotation speed of the second conveying screw 26 is the rotation speed in the steady state in the low-speed mode (S30). When the image formation onto the transfer material S is completed, the developing sleeve 28 and so on are stopped (S31). Then, the present image forming mode is recorded in the storage portion 75, and the rotation time of the developing sleeve 28 presently measured by the measuring portion 72 is integrated and recorded in the storage portion 75 (S32). Then, the image forming operation is terminated (S33).

Meanwhile, in the determination in S26, when the last image forming mode is not the normal mode and the present image forming mode is not switched to the low-speed mode, high-speed rotation is not required during a predetermined time from the start of the rotation of the first and second conveying screws 25 and 26 (S34). Thus, the developing sleeve 28 and so on are rotated as usual (S35). When the image formation onto the transfer material S is completed, the developing sleeve 28 is stopped (S36). Thereafter, as described above, the present image forming mode is recorded in the storage portion 75 (S32), and the image forming operation is terminated (S33). The information of the present image forming mode and the integrated rotation time are utilized in the next image formation.

Figure 11:
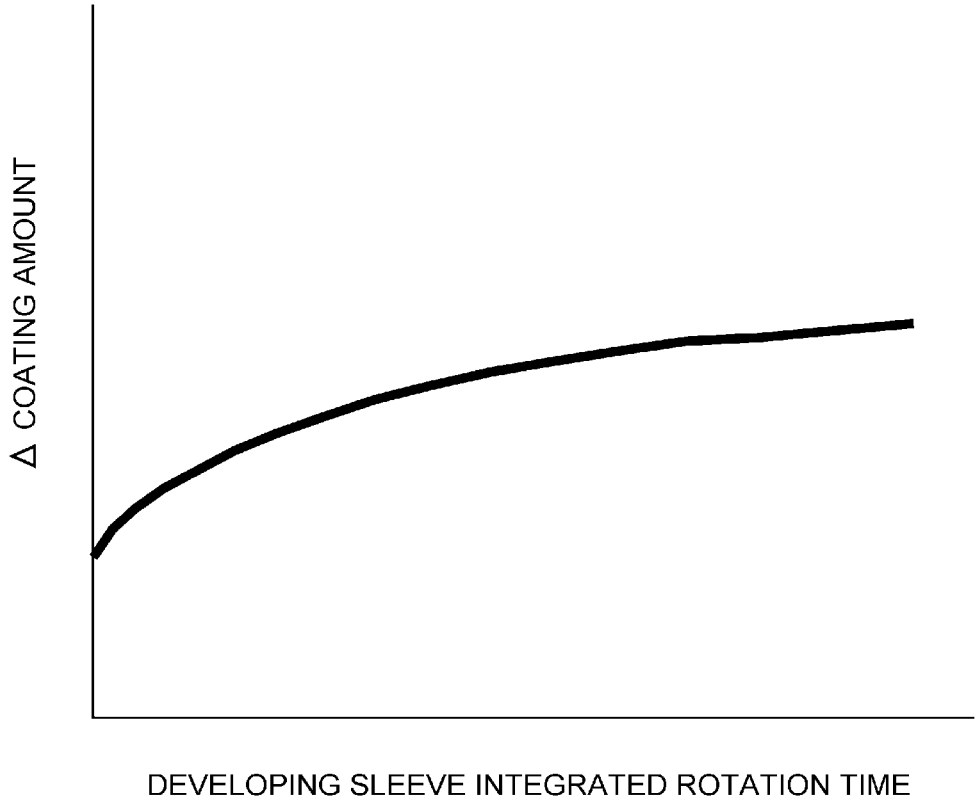
FIG. 11 is a view illustrating a difference of a coating amount with respect to an integrated rotation time of a developing sleeve.

In consideration of the development sleeve integrated rotation time, the control based on this will be described with reference to FIGS. 11 and 12. FIG. 11 is a view illustrating a difference of a coating amount with respect to the developing sleeve integrated rotation time. FIG. 12 is a diagram illustrating a relationship with a predetermined time till when the rotation speed is returned to the steady state with respect to the integrated rotation time according to the second embodiment.

The surface roughness of the developing sleeve 28 is reduced as the developing sleeve 28 is used for longer periods. Thus, as described above, as the surface roughness is reduced, a difference between the coating amount of the developer in the normal mode and the coating amount in the low-speed mode tends to become larger. The difference of the coating amount is a difference between the coating amount obtained when the developing sleeve 28 rotates in the normal mode (366 rpm) and the coating amount obtained when the developing sleeve 28 rotates in the low-speed mode (183 rpm).

As illustrated in FIG. 11, as the developing sleeve 28 is used for longer periods, the difference of the developer coating amount becomes larger. Consequently, the reduction amount of the developer in the developing chamber immediately after the image forming mode is switched from the normal mode to the low-speed mode is increased.

Thus, in the present embodiment, as illustrated in FIG. 12, the length of the predetermined time from when the rotation speed of the first and second conveying screws 25 and 26 is made high till when the rotation speed is returned to the speed in the steady state is changed corresponding to the integrated rotation time of the developing sleeve. Namely, as the integrated rotation time of the developing sleeve 28 is increased, the time when the rotation speed of the first and second conveying screws 25 and 26 is high is increased. According to this constitution, control is performed so that even if the difference of the coating amount on the developing sleeve 28 in the switching of the speed is large, the developer surface height of the developing chamber 23 is not lowered.

Figure 13:
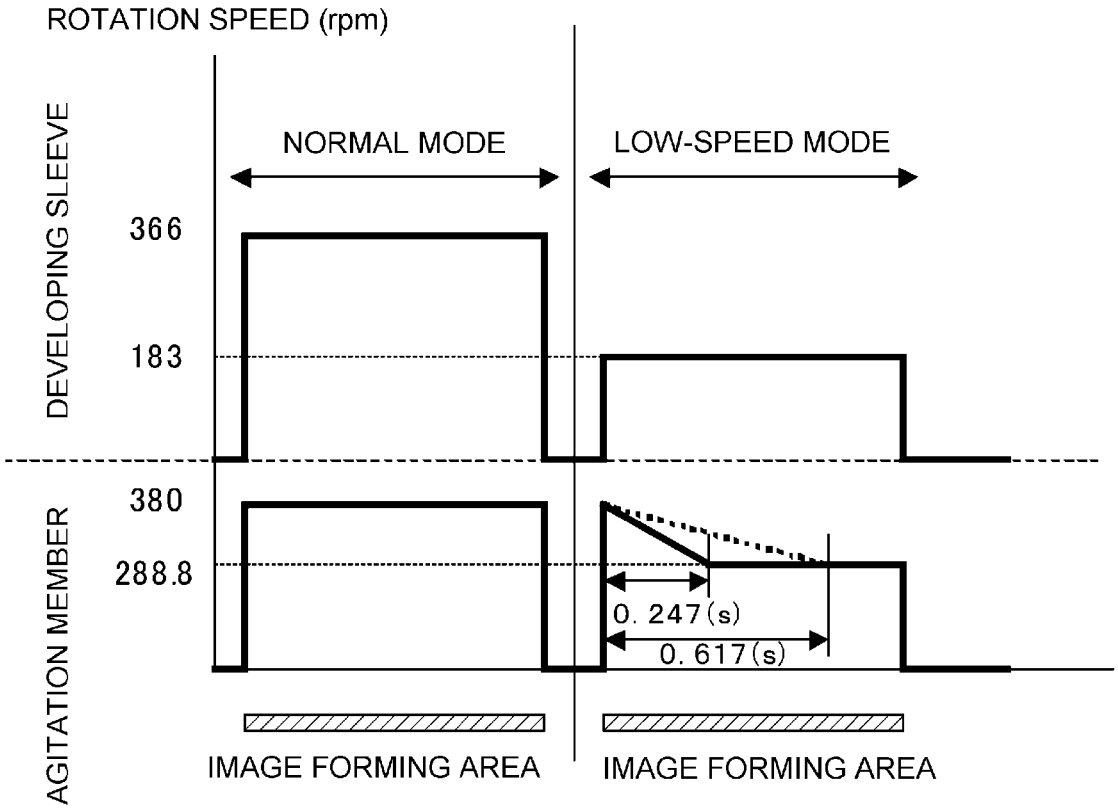
FIG. 13 is an image view of switching of the rotation speed according to the second embodiment.
Figure 14:
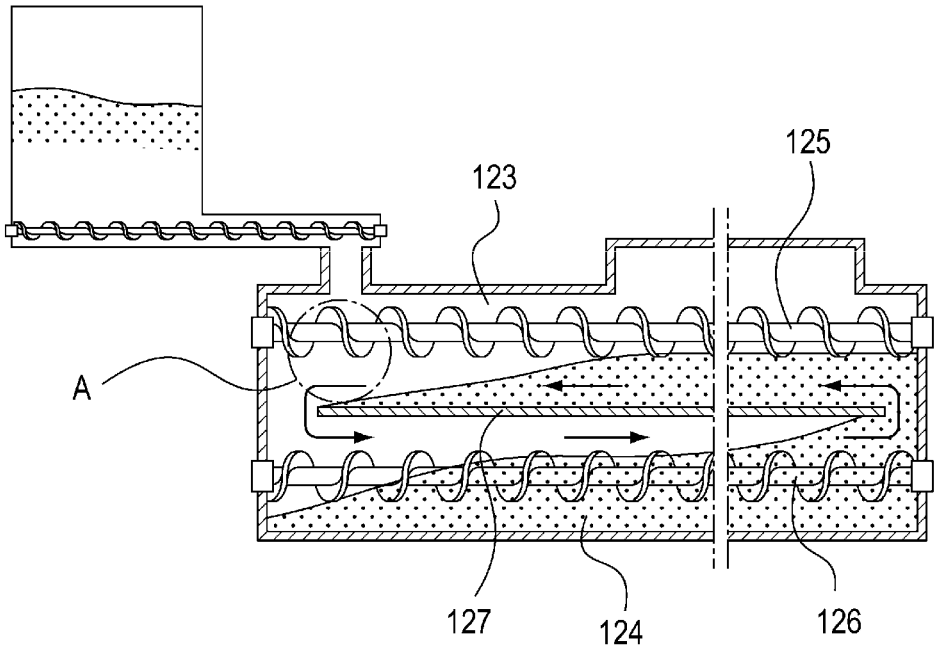
FIG. 14 PRIOR ART
FIG. 14 is an explanatory view for describing a developer surface height variation in the prior-art development device.

An image of switching the rotation speed in the present embodiment will be described with reference to FIG. 13. FIG. 13 is an image view of switching of the rotation speed according to the second embodiment. In FIG. 13, when the integrated rotation time of the developing sleeve 28 is less than 100 K or more, the rotation speed of the first and second conveying screws 25 and 26 is changed as shown by the solid lines. Meanwhile, when the integrated rotation time of the developing sleeve 28 is 350 K, the rotation speed is changed as shown by the dotted line. As illustrated in FIGS. 12 and 13, as the integrated rotation time of the developing sleeve 28 is increased, the predetermined time from when the rotation speed of the first and second conveying screws 25 and 26 is made high till when the rotation speed is returned to the steady speed is increased.

As in the first embodiment, the length of the predetermined time till when the rotation speed is returned to the steady speed illustrated in FIG. 12 can be set to an optimum value according to the configuration of the development device 4 in use and the type of the developer.

Further, as in the first embodiment, there may be provided a period in which the rotation speed of the conveying screw is gradually increased when the image forming mode is switched from the low-speed mode to the normal mode. The increased period may be lengthened corresponding to the durable state of the developing sleeve 28.

As described above, by virtue of the control shown in the present embodiment, even when the difference of the coating amount between the normal mode and the low-speed mode is increased by the use for long periods, the developer surface height of the developing chamber 23 can be suitably maintained. Thus, the coating failed phenomenon on the developing sleeve 28 can be reliably prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-278977, filed Dec. 15, 2010, which is hereby incorporated by reference herein in its entirety.

What is claimed is:

1. An image forming apparatus comprising:

an image bearing member;

a developer bearing body which is rotatably supported and bears and conveys developer to a developing position facing the image bearing member to develop a latent image formed on the image bearing member;

a first chamber which supplies the developer to the developer bearing body;

a second chamber which connects with the first chamber at opposite end portions to form a circulating path for the developer, with the second chamber facing the developer bearing body at its peripheral side at a position further upstream than the first chamber in a rotational direction of the developer bearing body and collecting developer which is charged on the developer bearing body before the developer is conveyed to a position facing the first chamber in a peripheral direction;

a first conveying member which conveys the developer in the first chamber;

a second conveying member which conveys the developer in the second chamber; and a controlling portion which performs a first mode to drive the developer bearing body at a first speed and performs a second mode to drive the developer bearing member at a second speed lower than the first speed, wherein in a case of performing the second mode after performing the first mode, the controlling portion starts to drive the first conveying member at a first predetermined speed and then shifts to a second predetermined speed lower than the first predetermined speed after changing a driving speed of the developer bearing member from the first mode to the second mode.

2. The image forming apparatus according to claim 1, wherein the controller gradually changes the speed of the first conveying member from the first predetermined speed to the second predetermined speed.

3. The image forming apparatus according to claim 1, wherein the controller temporarily stops driving of the first conveying member when changing from the first mode to the second mode.

4. The image forming apparatus according to claim 1, wherein, based on an integrated rotation time from the start of use of the developer bearing member, the controlling portion controls a target speed of the conveying member so as to increase a time of transition from a second target speed to a first target speed in the second mode.

5. The image forming apparatus according to claim 1, wherein, in a case a previous job is performed in the second mode and a next job will performed in the second mode, at a time to start the next job the controller starts driving the first conveying member at the second predetermined speed without driving it at the first predetermined speed.

6. The image forming apparatus according to claim 1, wherein the second predetermined speed is a driving speed of the first conveying member usually set in the second mode.

* * * * *